US009735522B2

(12) United States Patent
Chen et al.

(10) Patent No.: US 9,735,522 B2
(45) Date of Patent: Aug. 15, 2017

(54) ELECTRICAL RECEPTACLE CONNECTOR

(71) Applicant: Advanced-Connectek Inc., New Taipei (TW)

(72) Inventors: Ching-Tien Chen, New Taipei (TW); Shu-Lin Duan, Kunshan (CN); Wei Wan, Kunshan (CN); Fu-Yi Xu, Kunshan (CN)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/953,276

(22) Filed: Nov. 27, 2015

(65) Prior Publication Data

US 2016/0172790 A1 Jun. 16, 2016

(30) Foreign Application Priority Data

Dec. 11, 2014 (CN) ..... 2014 1 0754649

(51) Int. Cl.
*H01R 24/62* (2011.01)
*H01R 12/71* (2011.01)
*H01R 13/6594* (2011.01)

(52) U.S. Cl.
CPC ..... *H01R 24/62* (2013.01); *H01R 12/716* (2013.01); *H01R 13/6594* (2013.01)

(58) Field of Classification Search
CPC ..... H01R 24/60
See application file for complete search history.

(56) References Cited

U.S. PATENT DOCUMENTS

2015/0171574 A1* 6/2015 Little ..... H01R 24/60 439/78

OTHER PUBLICATIONS https://en.wikipedia.org/wiki/USB_Type-C, retrieved 7/19/2106.*

* cited by examiner

*Primary Examiner* — Ross Gushi
(74) *Attorney, Agent, or Firm* — Alan D. Kamrath; Kamrath IP Lawfirm, P.A.

(57) ABSTRACT

An electrical receptacle connector includes an insulating housing, receptacle terminals, and a shield shell covering the insulating housing. The receptacle terminals, arranged in a row and disposed on the insulating housing, sequentially include a first ground terminal, a first power terminal, two first differential signal terminals, a second power terminal, and a second ground terminal. The electrical receptacle connector is capable of receiving an electrical plug connector to be inserted therein in either upside-up or upside-down directions. The electrical plug connector includes upper-row plug terminals and lower-row plug terminals arranged in 2-fold rotational symmetry. Therefore, the electrical receptacle connector using the single-row receptacle terminals and the electrical plug connector using the corresponding double-row plug terminals compose a new type of USB Type-C connectors.

18 Claims, 8 Drawing Sheets

ELECTRICAL RECEPTACLE CONNECTOR

BACKGROUND OF THE INVENTION

1. Field of the Invention

The present invention relates to an electrical receptacle connector and, more particularly, to an electrical receptacle connector capable of receiving an electrical plug connector to be inserted therein in either upside-up or upside-down directions.

2. Description of the Prior Art

Electrical devices transfer electrical signals therebetween through the connection of electrical connectors, such as universal serial bus (USB) connectors commonly used in the field. The USB Type-C connectors include an electrical receptacle connector and an electrical plug connector, and the electrical receptacle connector is capable of receiving the electrical plug connector to be inserted therein in either upside-up or upside-down directions. The conventional electrical receptacle connector includes an insulating housing, double-row receptacle terminals, and a shield shell. The insulating housing made of plastic material includes a base and a tongue extending forwardly from a central portion of the base. The shield shell made of metallic material covers the insulating housing. The shield shell and the tongue cooperatively define a receiving cavity configured to receive the electrical plug connector to be inserted therein. The double-row receptacle terminals made of metallic material are disposed on the insulating housing. Contact portions of the receptacle terminals are separately disposed on upper and lower surfaces of the tongue, and, moreover, the upper-row receptacle terminals and the lower-row receptacle terminals are arranged in 2-fold rotational symmetry with respect to the central point of the receiving cavity. In other words, the upper-row receptacle terminals can be rotated about the central point by an angle of 180° to coincide with the lower-row receptacle terminals and vice versa.

When the electrical plug connector is inserted in the receiving cavity of the electrical receptacle connector in the upside-up direction, single-row plug terminals of the electrical plug connector contact the upper-row receptacle terminals of the electrical receptacle connector to transfer the first set of signals. When the electrical plug connector is inserted in the receiving cavity of the electrical receptacle connector in the upside-down direction, the single-row plug terminals of the electrical plug connector contact the lower-row receptacle terminals of the electrical receptacle connector to transfer the second set of signals. The transfer specification of the first set of signals is the same as that of the second set of signals so that the electrical plug connector inserted in the electrical receptacle connector in the upside-up or upside-down direction provides the same transfer function.

SUMMARY OF THE INVENTION

The present invention is adapted to providing an electrical receptacle connector which uses single-row receptacle terminals and is capable of receiving an electrical plug connector to be inserted therein in either upside-up or upside-down directions.

According to an aspect of the present invention, there is provided an electrical receptacle connector including a receiving cavity configured to receive an electrical plug connector to be inserted therein. The electrical plug connector includes a plurality of upper-row plug terminals and a plurality of lower-row plug terminals, and the upper-row plug terminals and the lower-row plug terminals are arranged in 2-fold rotational symmetry with respect to a central point of the receiving cavity. The electrical receptacle connector includes an insulating housing, a plurality of receptacle terminals, and a shield shell. The receptacle terminals are arranged in a row and disposed on the insulating housing. The receptacle terminals sequentially include a first ground terminal, a first power terminal, two first differential signal terminals, a second power terminal, and a second ground terminal. The shield shell covers the insulating housing, and the shield shell and the tongue cooperatively define the receiving cavity.

According to another aspect of the present invention, the receptacle terminals further include two second differential signal terminals disposed between the first ground terminal and the first power terminal. The receptacle terminals further include two third differential signal terminals disposed between the second power terminal and the second ground terminal.

According to another aspect of the present invention, the receptacle terminals further include a detection terminal disposed between the first power terminal and the two first differential signal terminals.

According to another aspect of the present invention, the receptacle terminals further include a reserved terminal disposed between the two first differential signal terminals and the second power terminal.

According to another aspect of the present invention, the receptacle terminals are of a flat-plate type. The upper-row plug terminals and the lower-row plug terminals are of a spring-arm type.

According to another aspect of the present invention, the receptacle terminals are of a spring-arm type. The upper-row plug terminals and the lower-row plug terminals are of a flat-plate type.

According to another aspect of the present invention, the receptacle terminals are retained in the insulating housing by using insert molding.

According to another aspect of the present invention, the receptacle terminals are of a surface-mount-technology (SMT) type or of a through-hole type.

According to another aspect of the present invention, the insulating housing includes a base and a tongue extending forwardly from a central portion of the base. Each receptacle terminal includes a retaining portion, a contact portion, and a soldering portion. The retaining portions are retained in the base. The contact portions extend forwardly from the retaining portions and are disposed on a surface of the tongue. The soldering portions extend from the retaining portions and out of the base.

According to another aspect of the present invention, a protrusion bar is formed at the front of the surface of the tongue. Front ends of the contact portions of the receptacle terminals are embedded in the protrusion bar.

It is remarked that the aforementioned aspects or features can also be combined with each other and are in the scope of the present invention as well.

Therefore, in the present invention, the electrical receptacle connector using the single-row receptacle terminals and the electrical plug connector using the corresponding double-row plug terminals compose a new type of USB Type-C connectors.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
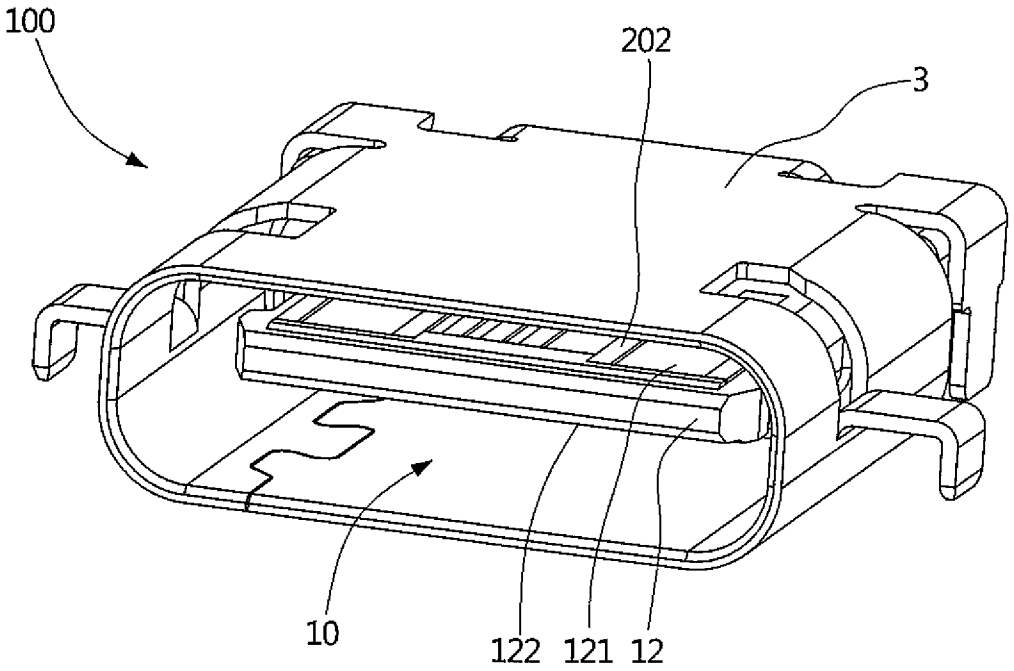
FIG. 1 is a perspective view of an electrical receptacle connector according to the first embodiment of the present invention.

Reference will now be made in detail to the present embodiments of the invention, examples of which are illustrated in the accompanying drawings. Wherever possible, the same reference numbers are used in the drawings and the description to refer to the same or like parts. Directional terms, such as up, down, left, right, front, and back, may be used with respect to the drawings. These and similar directional terms should not be construed to limit the scope of the present invention in any manner.

Figure 2:
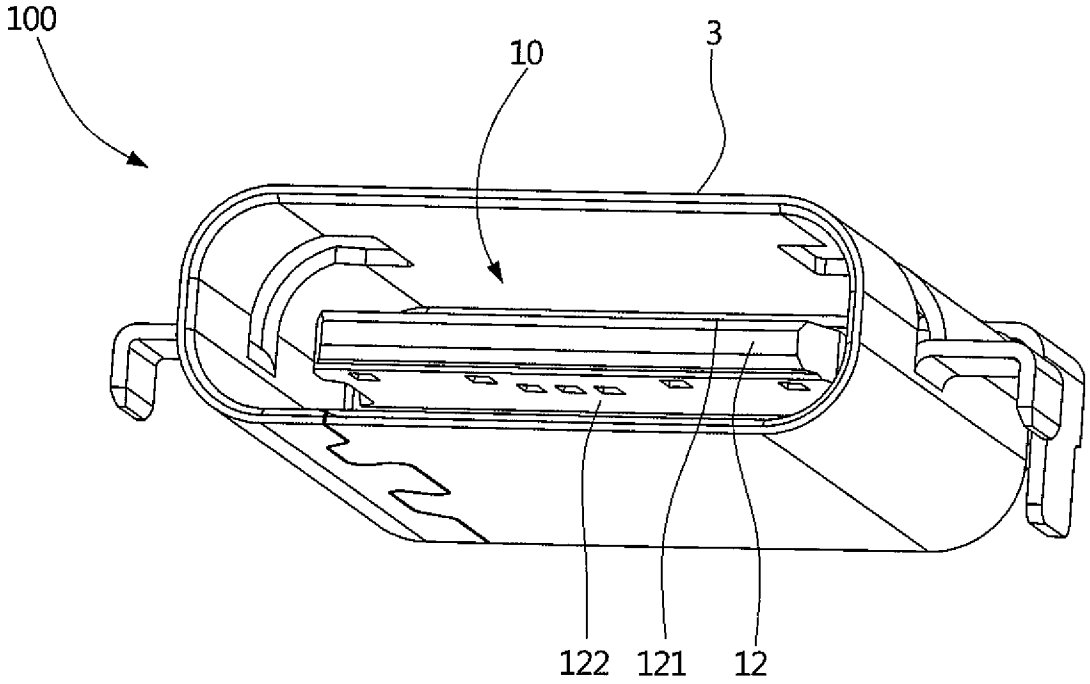
FIG. 2 is another perspective view of the electrical receptacle connector according to the first embodiment of the present invention.
Figure 3:
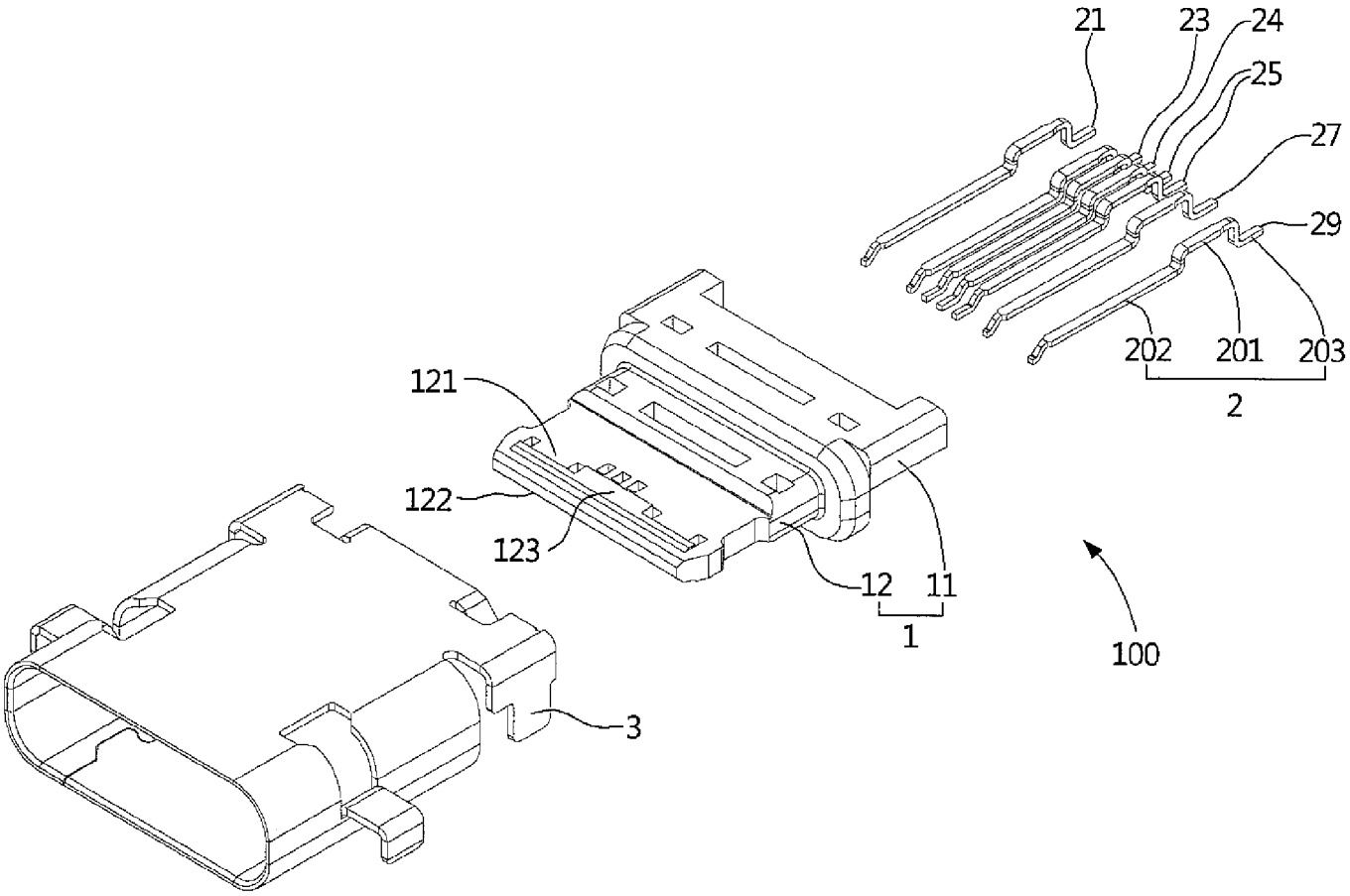
FIG. 3 is an exploded diagram of the electrical receptacle connector according to the first embodiment of the present invention.

Referring to FIGS. 1-4, there is provided an electrical receptacle connector 100 according to the first embodiment of the present invention. The electrical receptacle connector 100 conforms to the USB Type-C Cable and Connector Specification, Version 1.0 RC4. As shown in FIG. 3, the electrical receptacle connector 100 includes an insulating housing 1, receptacle terminals 2, and a shield shell 3. Generally speaking, the insulating housing 1 is made of plastic material to have the electrical insulating property, the receptacle terminals 2 are made of metallic material to quickly transfer signals, and the shield shell 3 is made of metallic material to shield electromagnetic waves to suppress electromagnetic interference (EMI).

The insulating housing 1 includes a base 11 and a tongue 12 extending forwardly from a central portion of the base 11. The tongue 12 includes an upper surface 121, a lower surface 122, and a protrusion bar 123 formed at the front of the upper surface 121. The receptacle terminals 2 are arranged in a row and disposed on the insulating housing 1. Each receptacle terminal 2 includes a retaining portion 201, a contact portion 202, and a soldering portion 203. The retaining portions 201 are retained in the base 11, the contact portions 202 extend forwardly from the retaining portions 201 and are disposed on the upper surface 121 of the tongue 12, and the soldering portions 203 extend from the retaining portions 201 and out of the base 11. The shield shell 3 covers the insulating housing 1. That is to say, the shield shell 3 covers the insulating housing 1 and the receptacle terminals 2 disposed thereon. As shown in FIGS. 1 and 2, the shield shell 3 and the tongue 12 cooperatively define a receiving cavity 10 configured to receive an electrical plug connector (not shown) to be inserted therein.

Figure 4:
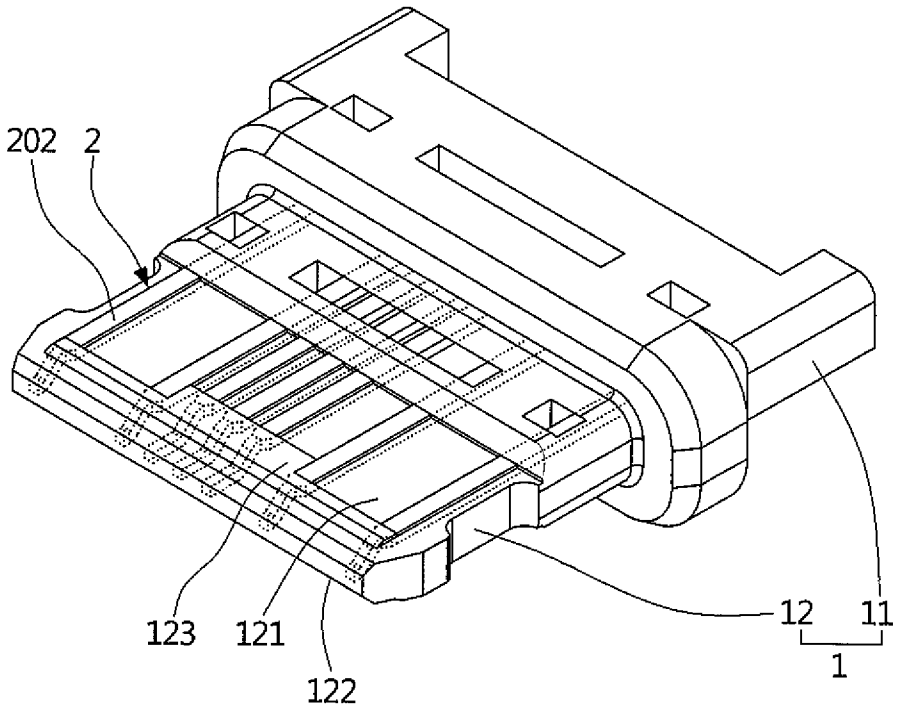
FIG. 4 is an assembled diagram of an insulating housing and receptacle terminals of the electrical receptacle connector according to the first embodiment of the present invention.

In the embodiment, the receptacle terminals 2 are retained in the insulating housing 1 by using insert molding to be convenient to assemble and have stable quality. As shown in FIG. 4, front ends of the contact portions 202 of the receptacle terminals 2 are embedded in the protrusion bar 123 formed at the front of the upper surface 121 of the tongue 12. The protrusion bar 123 is configured to envelop blanking slopes formed at the front ends of the contact portions 202 of the receptacle terminals 2 to be convenient to process mold workpieces. The receptacle terminals 2 are of a SMT type to be capable of being directly soldered onto a surface of a circuit board (not shown). That is to say, the soldering portion 203 of each receptacle terminal 2 is formed by extending backwardly from the retaining portion 201 and out of the base 11, then bending and extending downwardly, and then bending and extending backwardly. However, the embodiment is not intended to be limited to the present configuration. For example, the receptacle terminals may be designed to be assembled to and retained in the insulating housing by engaging with slots preformed in the insulating housing. Moreover, the receptacle terminals may be designed to be of a through-hole type to be capable of being a through-hole soldered to the circuit board or inserted in a socket disposed on the circuit board. That is to say, the soldering portion of each receptacle terminal is formed by bending and extending downwardly from the retaining portion and out of the base.

In addition, the receptacle terminals 2 disposed on the insulating housing 1 are arranged in a row to form single-row receptacle terminals. The receptacle terminals 2 sequentially include a first ground terminal 21 (GND), a first power terminal 23 (VBUS), a detection terminal 24 (CC), two first differential signal terminals 25 (D+ and D−), a second power terminal 27 (VBUS), and a second ground terminal 29 (GND). Therefore, the receptacle terminals 2 conform to the arrangement of terminals of the USB 2.0 specification.

Figure 5:
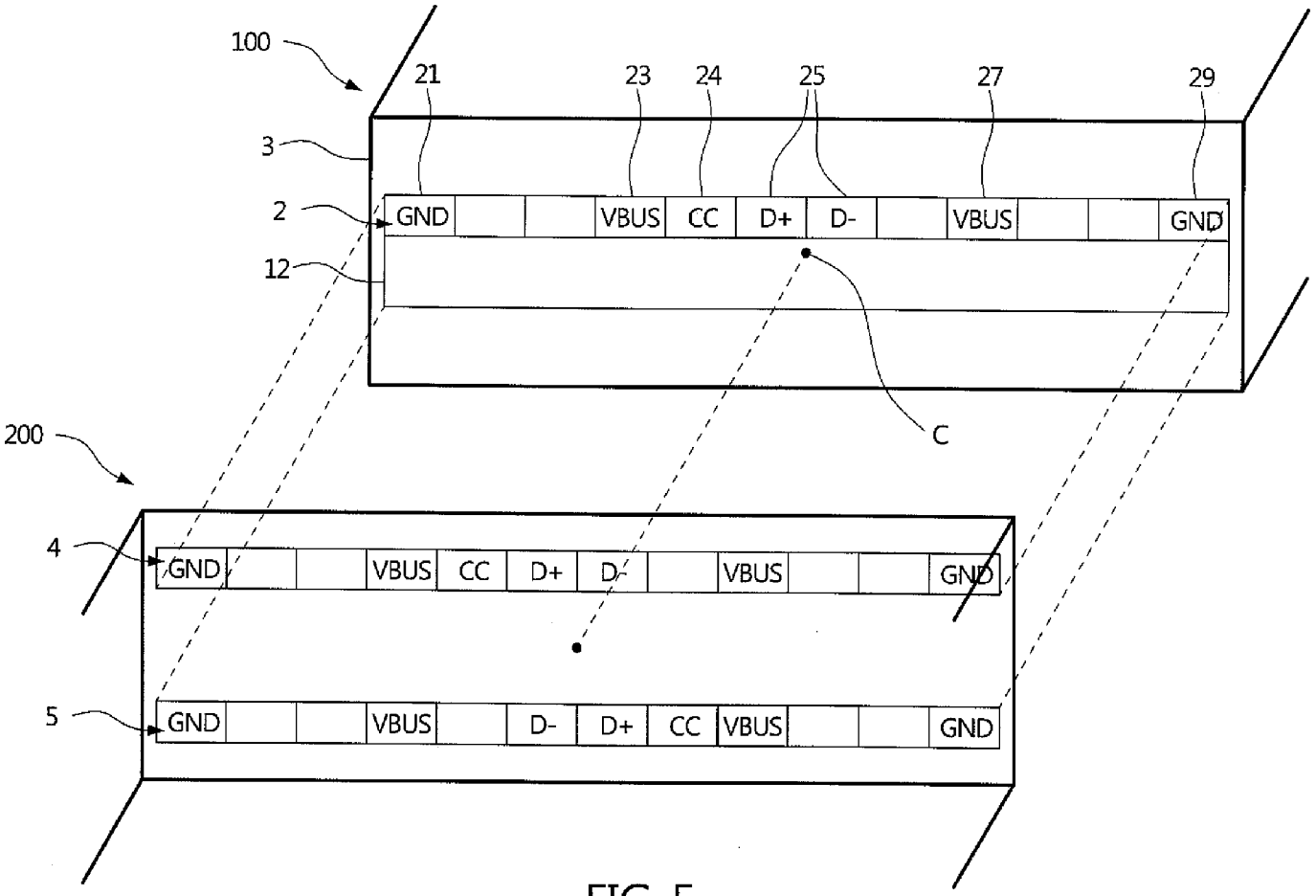
FIG. 5 is a schematic diagram showing the connection of the electrical receptacle connector and an electrical plug connector according to the first embodiment of the present invention.

Referring to FIG. 5, there is provided a schematic diagram showing the connection of the electrical receptacle connector 100 and an electrical plug connector 200 according to the first embodiment of the present invention. To implement the electrical receptacle connector 100 capable of receiving the electrical plug connector 200 to be inserted therein in either upside-up or upside-down directions, the electrical plug connector 200 uses double-row plug terminals, upper-row plug terminals 4 and lower-row plug terminals 5. The upper-row plug terminals 4 and the lower-row plug terminals 5 are arranged in 2-fold rotational symmetry with respect to a central point C of the receiving cavity 10. An object with n-fold rotational symmetry with respect to a particular point means that rotation by an angle of 360°/n does not change the object. That is to say, the upper-row plug terminals 4 can be rotated about the central point C of the receiving cavity 10 by an angle of 180° (=360°/2) to coincide with the lower-row plug terminals 5. Moreover, the lower-row plug terminals 5 can be rotated about the central point C of the receiving cavity 10 by the angle of 180° to coincide with the upper-row plug terminals 4.

Therefore, as shown in FIG. 5, when the electrical plug connector 200 is inserted in the electrical receptacle connector 100 in the upside-up direction, the first set of signals is transferred. The transfer specification of the first set of signals is GND, VBUS, CC, D+, D−, VBUS, and GND in sequence from left to right. When the electrical plug connector 200 is inserted in the electrical receptacle connector 100 in the upside-down direction, the second set of signals is transferred. The, transfer specification of the second set of signals is GND, VBUS, CC, D+, D−, VBUS, and GND in sequence from left to right. The transfer specification of the first set of signals is the same as that of the second set of signals, so that the electrical plug connector 200 can be inserted in the electrical receptacle connector 100 in the upside-up or upside-down direction to transfer signals.

In addition, in the embodiment, as shown in FIG. 4, the receptacle terminals 2 of the electrical receptacle connector 100 are of a flat-plate type. Correspondingly, the upper-row plug terminals 4 and the lower-row plug terminals 5 of the electrical plug connector 200 are of a spring-arm type. Therefore, the connections of the flat-plate type terminals and the spring-arm type terminals provide insertion and extraction forces. However, the embodiment is not intended to be limited to the present configuration. For example, the receptacle terminals of the electrical receptacle connector may be designed to be spring-arm type terminals, and the corresponding plug terminals of the electrical plug connector may be designed to be flat-plate type terminals.

Figure 6:
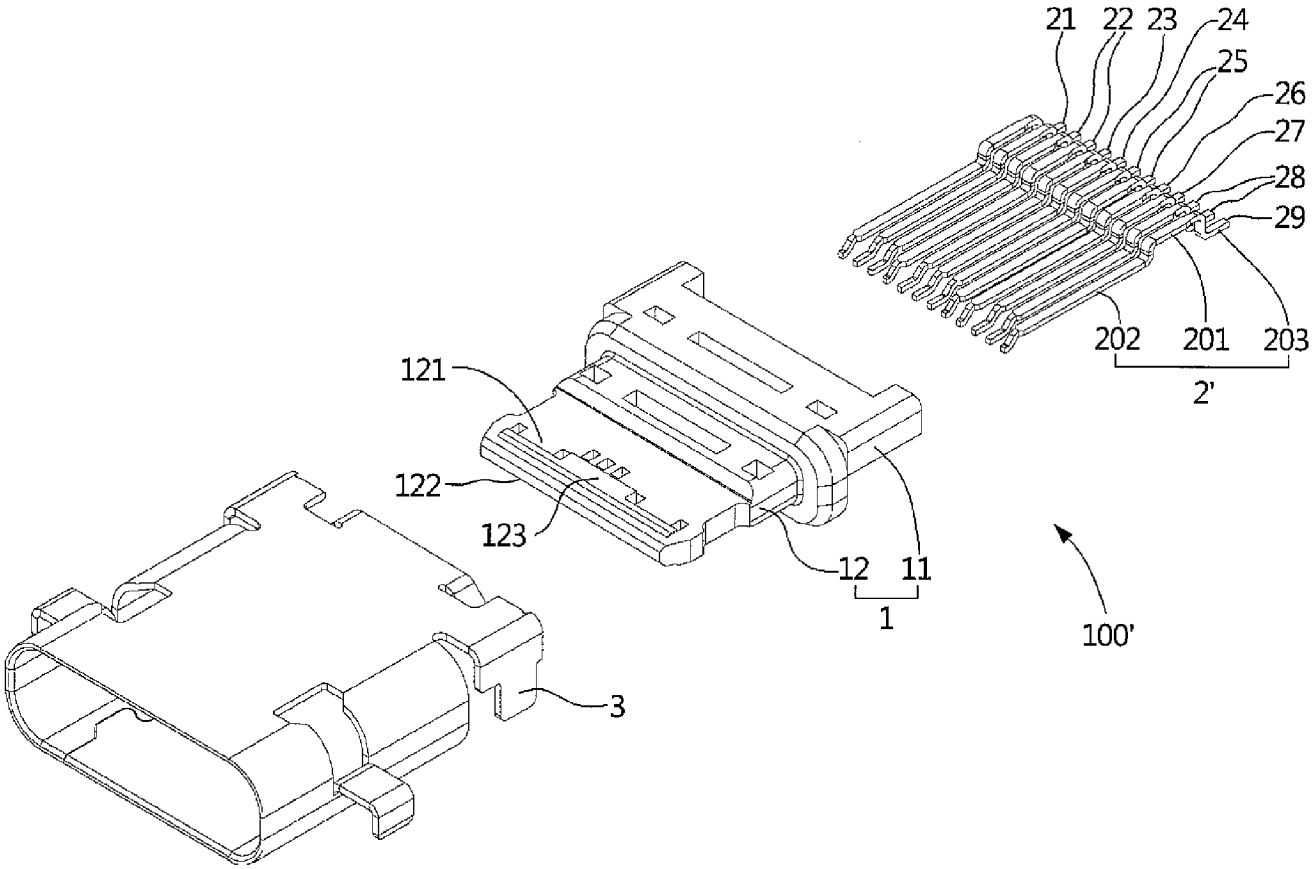
FIG. 6 is an exploded diagram of an electrical receptacle connector according to the second embodiment of the present invention.
Figure 7:
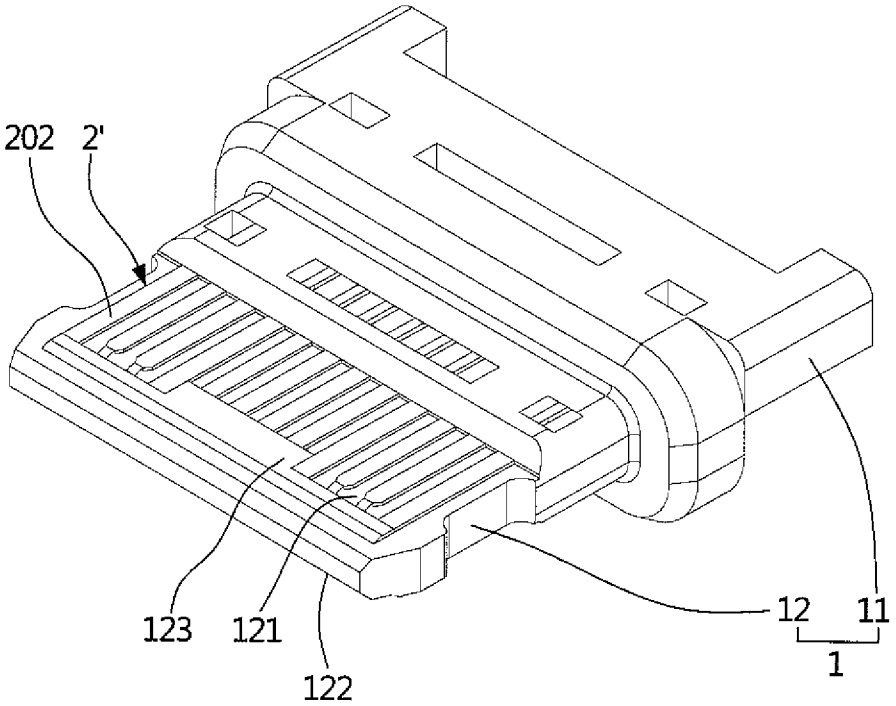
FIG. 7 is an assembled diagram of an insulating housing and receptacle terminals of the electrical receptacle connector according to the second embodiment of the present invention.

Referring to FIGS. 6 and 7, there is provided an electrical receptacle connector 100' according to the second embodiment of the present invention. Compared to the electrical receptacle connector 100 as shown in FIGS. 3 and 4, receptacle terminals 2' disposed on the insulating housing 1 of the electrical receptacle connector 100' are also arranged in a row to form single-row receptacle terminals. The receptacle terminals 2' sequentially include the first ground terminal 21 (GND), two second differential signal terminals 22 (TX+ and TX−), the first power terminal 23 (VBUS), the detection terminal 24 (CC), the two first differential signal terminals 25 (D+ and D−), a reserved terminal 26 (RFU), the second power terminal 27 (VBUS), two third differential signal terminals 28 (RX− and RX+), and the second ground terminal 29 (GND). Therefore, the receptacle terminals 2' conform to the arrangement of terminals of the USB 3.0 specification.

Figure 8:
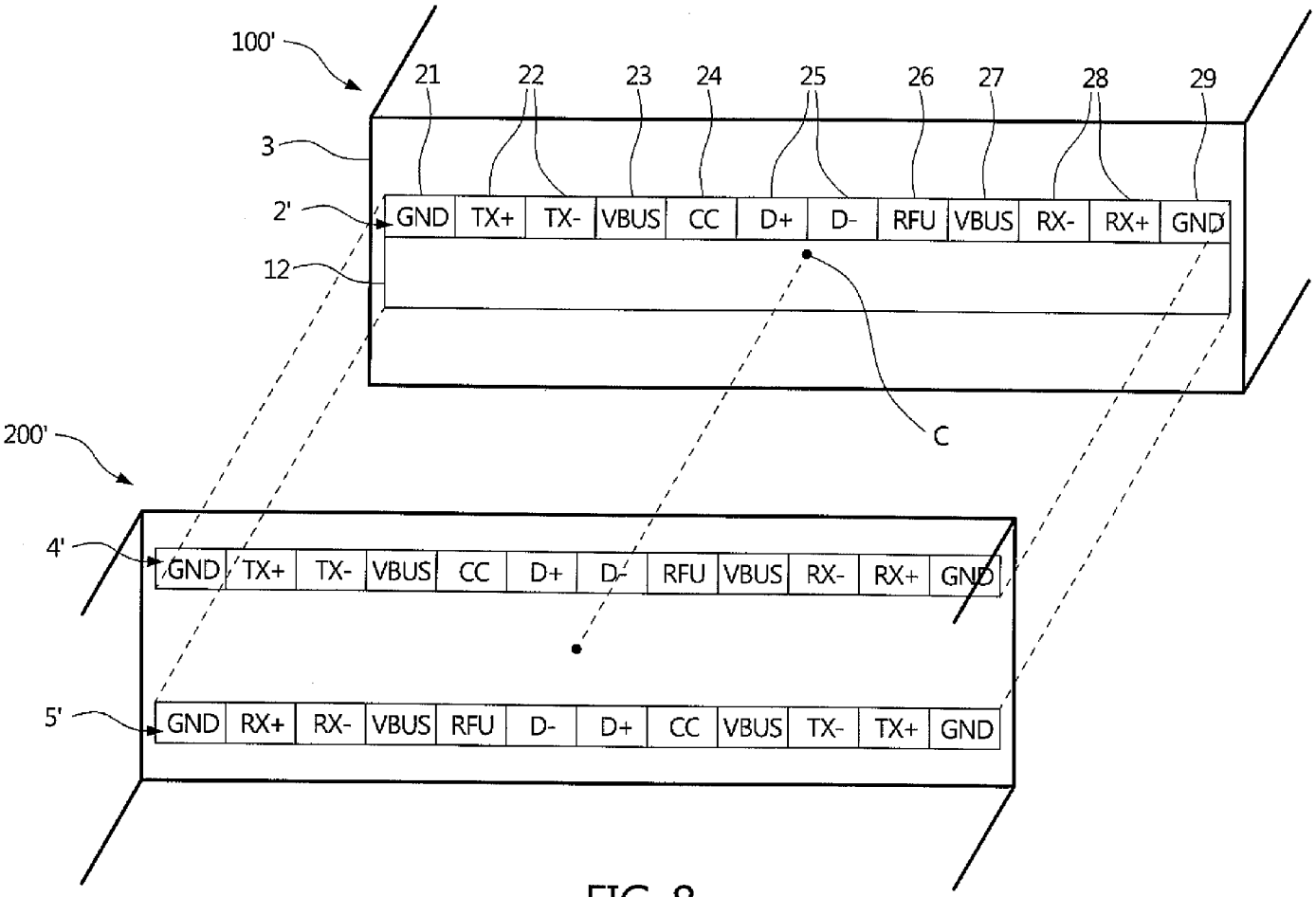
FIG. 8 is a schematic diagram showing the connection of the electrical receptacle connector and an electrical plug connector according to the second embodiment of the present invention.

Referring to FIG. 8, there is provided a schematic diagram showing the connection of the electrical receptacle connector 100' and an electrical plug connector 200' according to the second embodiment of the present invention. To implement the electrical receptacle connector 100' capable of receiving the electrical plug connector 200' to be inserted therein in either upside-up or upside-down directions, the electrical plug connector 200' uses double-row plug terminals, upper-row plug terminals 4' and lower-row plug terminals 5'. The upper-row plug terminals 4' and the lower-row plug terminals 5' are arranged in 2-fold rotational symmetry with respect to a central point C of the receiving cavity. Therefore, as shown in FIG. 8, when the electrical plug connector 200' is inserted in the electrical receptacle connector 100' in the upside-up direction, the first set of signals is transferred, and the transfer specification of the first set of signals is GND, TX+, TX−, VBUS, CC, D+, D−, RFU, VBUS, RX−, RX+, and GND in sequence from left to right. When the electrical plug connector 200' is inserted in the electrical receptacle connector 100' in the upside-down direction, the second set of signals is transferred, and the transfer specification of the second set of signals is GND, TX+, TX−, VBUS, CC, D+, D−, RFU, VBUS, RX−, RX+, and GND in sequence from left to right. The transfer specification of the first set of signals is the same as that of the second set of signals, so that the electrical plug connector 200' can be inserted in the electrical receptacle connector 100' in the upside-up or upside-down direction to transfer signals.

It will be apparent to those skilled in the art that various modifications and variations can be made to the structure of the present invention without departing from the scope or spirit of the present invention. In view of the foregoing, it is intended that the present invention cover modifications and variations of this invention provided they fall within the scope of the following claims and their equivalents.

What is claimed is:

1. An electrical receptacle connector for receiving an electrical plug connector to be inserted therein in either upside-up or upside-down directions, with the electrical plug connector having a plurality of upper-row plug terminals and a plurality of lower-row plug terminals, with the plurality of upper-row plug terminals and the plurality of lower-row plug terminals arranged in 2-fold rotational symmetry, wherein the electrical receptacle connector comprises:

a shield shell in part defining a receiving cavity having a central point, with the receiving cavity configured to receive the electrical plug connector having the plurality of upper-row plug terminals and the plurality of lower-row plug terminals arranged in 2-fold rotational symmetry with respect to the central point of the receiving cavity;

an insulating housing; and a plurality of receptacle terminals for electrical connection configured with all of the plurality of receptacle terminals contacting one of the plurality of upper-row plug terminals and the plurality of lower-row plug terminals, with the plurality of receptacle terminals arranged in a row and disposed only on an upper surface of the insulating housing, wherein the plurality of receptacle terminals sequentially comprises a first ground terminal, a first power terminal, two first differential signal terminals, a second power terminal, and a second ground terminal, with the shield shell covering the insulating housing.

2. The electrical receptacle connector of claim 1, wherein the plurality of receptacle terminals further comprises two second differential signal terminals disposed between the first ground terminal and the first power terminal, and two third differential signal terminals disposed between the second power terminal and the second ground terminal.

3. The electrical receptacle connector of claim 1, wherein the plurality of receptacle terminals further comprises a detection terminal disposed between the first power terminal and the two first differential signal terminals.

4. The electrical receptacle connector of claim 1, wherein the plurality of receptacle terminals further comprises a reserved terminal disposed between the two first differential signal terminals and the second power terminal.

5. The electrical receptacle connector of claim 1, wherein each of the plurality of receptacle terminals is of a flat-plate type, and wherein each of the plurality of upper-row plug terminals and each of the plurality of lower-row plug terminals are of a spring-arm type.

6. The electrical receptacle connector of claim 1, wherein each of the plurality of receptacle terminals is of a spring-arm type, and wherein each of the plurality of upper-row plug terminals and each of the plurality of lower-row plug terminals are of a flat-plate type.

7. The electrical receptacle connector of claim 1, wherein each of the plurality of receptacle terminals is retained in the insulating housing by using insert molding.

8. The electrical receptacle connector of claim 1, wherein each of the plurality of receptacle terminals is of a surface-mount-technology (SMT) type or of a through-hole type.

9. The electrical receptacle connector of claim 1, wherein the insulating housing comprises a base and a tongue extending forwardly from a central portion of the base, wherein each of the plurality of receptacle terminals comprises a retaining portion, a contact portion, and a soldering portion, wherein the retaining portion is retained in the base, the contact portion extends forwardly from the retaining portion and is disposed on a surface of the tongue, and the soldering portion extends from the retaining portion and out of the base.

10. The electrical receptacle connector of claim 1, wherein an opposite lower surface of the insulating housing is free of receptacle terminals.

11. The electrical receptacle connector of claim 1, wherein the insulating housing comprises a base, a tongue extending forwardly from a central portion of the base, and a protrusion bar formed on a surface at a front of the tongue opposite to the base, wherein each of the plurality of receptacle terminals comprises a retaining portion, a contact portion, and a soldering portion, wherein the retaining portion is retained in the base, the contact portion extends forwardly from the retaining portion and is disposed on the surface of the tongue, and the soldering portion extends from the retaining portion away from the contact portion and out of the base, and wherein front ends of the contact portions of the plurality of receptacle terminals opposite to the base are surrounded by the protrusion bar and the surface of the tongue.

12. The electrical receptacle connector of claim 11, wherein the plurality of receptacle terminals further comprises two second differential signal terminals disposed between the first ground terminal and the first power terminal, and two third differential signal terminals disposed between the second power terminal and the second ground terminal.

13. The electrical receptacle connector of claim 11, wherein the plurality of receptacle terminals further comprises a detection terminal disposed between the first power terminal and the two first differential signal terminals.

14. The electrical receptacle connector of claim 11, wherein the plurality of receptacle terminals further comprises a reserved terminal disposed between the two first differential signal terminals and the second power terminal.

15. The electrical receptacle connector of claim 11, wherein each of the plurality of receptacle terminals is of a flat-plate type, and wherein each of the plurality of upper-row plug terminals and each of the plurality of lower-row plug terminals are of a spring-arm type.

16. The electrical receptacle connector of claim 11, wherein each of the plurality of receptacle terminals is of a spring-arm type, and wherein each of the plurality of upper-row plug terminals and each of the plurality of lower-row plug terminals are of a flat-plate type.

17. The electrical receptacle connector of claim 11, wherein the plurality of receptacle terminals is retained in the insulating housing by using insert molding.

18. The electrical receptacle connector of claim 11, wherein each of the plurality of receptacle terminals is of a surface-mount-technology (SMT) type or of a through-hole type.

* * * * *